US007353546B2

(12) United States Patent
Hunt

(10) Patent No.: US 7,353,546 B2
(45) Date of Patent: Apr. 8, 2008

(54) SPORTS APPARATUS FOR SECURING THE POSITION OF PROTECTIVE PADS

(76) Inventor: Matthew W. Hunt, 3734 Chattahoochee Summit Dr., Atlanta, GA (US) 30339

( * ) Notice: Subject to any disclaimer, the term of this patent is extended or adjusted under 35 U.S.C. 154(b) by 0 days.

(21) Appl. No.: 11/181,356

(22) Filed: Jul. 14, 2005

(65) Prior Publication Data

US 2007/0011798 A1 Jan. 18, 2007

(51) Int. Cl.
*A41D 13/00* (2006.01)

(52) U.S. Cl. ..... 2/459

(58) Field of Classification Search ..... 2/459, 2/461, 462, 463, 467, 44, 45, 267, 268, 92, 2/455, 102, 16, 908
See application file for complete search history.

(56) References Cited

U.S. PATENT DOCUMENTS 1,970,130 A * 8/1934 Dickenson ..... 2/462
6,553,579 B1 * 4/2003 Gillen et al. ..... 2/268
6,845,522 B2 1/2005 Beland
6,966,070 B2 * 11/2005 Gillen et al. ..... 2/102

* cited by examiner

*Primary Examiner*—Tejash Patel
(74) *Attorney, Agent, or Firm*—Withers & Keys, LLC

(57) ABSTRACT

Securing devices secure the position of protective pads on the arms of a user of the protective pads. A sheet of material having an aperture is placed over the head with the head of the user passing through the aperture. The sheet of material may be pliable so as to fit to the shoulders of the user. Suspension members are connected to the sheet of material on opposite sides of the aperture and the suspension members include attachment devices on distal ends. The attachment devices connect to the protective pads of the wearer to hold the protective pads in place. The attachment devices may be detachable from the protective pads so that the user may utilize the securing device in conjunction with protective pads that the user already has.

20 Claims, 3 Drawing Sheets

SPORTS APPARATUS FOR SECURING THE POSITION OF PROTECTIVE PADS

TECHNICAL FIELD

The present invention relates to a protective pad securing device worn by sports participants for securing protective pads in the proper position during play.

BACKGROUND

Protective pads, such as arm and elbow pads, are used widely to protect a sportsman's arm and elbow during contact or highly physical sports. Players engaged in a wide variety of sports use elbow pads of one design or another including, for example, field games such football, hockey, lacrosse, field hockey, rugby and individual or team sports such as, for example, the luge, toboggan, skiing and rock climbing.

The most common elbow pads are stand alone pads. A stand alone pad utilizes one or more elastic bands incorporated into the pad design that encase the arm and hold the pad in place through friction. Other types of stand alone pads use hook and loop straps attached to each side of the pad which are used to cinch the pad against the arm. Other types of stand alone pads use an inner layer of neoprene rubber to create a tackier surface to prevent slippage. These devices are light weight, relatively inexpensive and easily adjusted to the wearer. Overtime the pad tends to adapt itself to the wearer or the wearer becomes accustomed to that particular set of pads.

However, these types of elbow pads each present drawbacks. While all of these types of stand alone elbow pads work well prior to competition, all of them will inevitably slide down the players arm due to perspiration, stretching of the fastening mechanism, physical inertia and player contact. The chronic slippage is a distraction from the game requiring the wearer to constantly readjust the pad during play.

SUMMARY

Embodiments of the present invention address these issues and others by providing a sheet of material that includes various features conducive to securing protective pads in the proper position to prevent arm injuries. For example, features of some embodiments provide for a pliant sheet of material to be worn over the head and around the neck. In one particular embodiment that allows for existing protective pads to be used, the light weight pliable sheet of material provides a comfortable platform from which to suspend any stand alone protective pads allowing the user to utilize their current equipment.

The present invention may be viewed as a sports apparatus that includes a sheet of pliable material bounded by a continuous outer edge and containing an aperture therein bounded by a continuous inner edge of the sheet of pliable material. A first means for detachably suspending a protective pad from the sheet of pliable material is included. A second means for detachably suspending a protective pad from the sheet of pliable material at a position on substantially the opposite side of the aperture from the first suspension means is also included.

The present invention may be viewed as a sports apparatus that includes a sheet of material bounded by a continuous outer edge containing an aperture therein bounded by a continuous inner edge of the sheet of material. A first strap that is connected to the sheet of material proximate to the inner edge of the aperture has a connected end connected to the sheet of material and a distal end. A second strap that is connected to the sheet of material at a position substantially on the opposite side of the aperture from the first strap and proximate to the inner edge of the aperture has a connected end connected to the sheet of material and a distal end. A first attachment means for connecting to a protective pad is included and is connected to the distal end of the first strap, and a second attachment means for connecting to a protective pad is included and is connected to the distal end of the second strap.

The present invention may also be viewed as a sports apparatus that includes a sheet of pliable material bounded by a continuous outer edge and containing an aperture therein bounded by a continuous inner edge of the sheet of pliable material. A first suspension member with a distal end and a secured end is included, and the secured end is connected to the sheet of pliable material. A second suspension member with a distal end and a secured end is included, and the secured end is connected to the sheet of pliable material at a position on substantially the opposite side of the aperture from the first suspension member. A first attachment device is connected to the distal end of the first suspension member, and a second attachment device is connected to the distal end of the second suspension member.

DETAILED DESCRIPTION

Embodiments of the present invention include protective pad securing devices and associated methods of manufacturing, wearing and attaching securing devices to a variety of protective pads. Certain embodiments of securing devices include various features such as the shape and cut of the pliable sheet of material worn around the neck and over the shoulders. Certain embodiments of securing devices secure the suspension straps on the underside of the pliable sheet of material while others secure the suspension straps from the top side of the pliable sheet of material. Furthermore, certain embodiments of protective pad securing devices provide for various ways to attach the securing device to the wearer's preferred protective pads allowing the wearer to attach and detach the protective pads without tools.

FIGS. 1-4 show various views of illustrative embodiments of a securing device. The securing device 100 of the embodiment of FIGS. 1 and 2 includes a sheet of material 102. As can be seen in the front view of FIG. 2 the size of the sheet of material 102 can be of any size so as to provide a comfortable fit for the wearer depending on the wearer's neck size and shoulder width. One manner of fitting the apparatus to a wearer would be to have the outer edge of the sheet of material 102 extend past the edge of the shoulder and extend 2-4 inches onto the wearer's chest and back.

It will be appreciated that the pliable sheet of material 102 can be composed of any desired material and its shape can be of any desired shape according to the taste of the wearer or requirements for range of motion of the activity. In the embodiment shown, the sheet of material 102 is cut in the shape of an ellipse with a minor axis approximately three quarters the length of the major axis so that the sheet 102 extends from shoulder to shoulder for the major axis but then extends partially down the chest and back of the wearer along the minor axis.

In some embodiments, the sheet material 102 is pliable. Examples of such a pliable material include neoprene of various thicknesses (e.g., 5 mm thickness) cloth, rubber, plastic, and canvas. The pliable sheet of material 102 can also be made up of combination of materials to meet the requirements of the wearer, such as for flexibility and comfort. The pliable nature of the sheet 102 allows for the sheet 102 to fit to the shoulders of the wearer for increased comfort and stability of the securing device 100.

Figure 1:
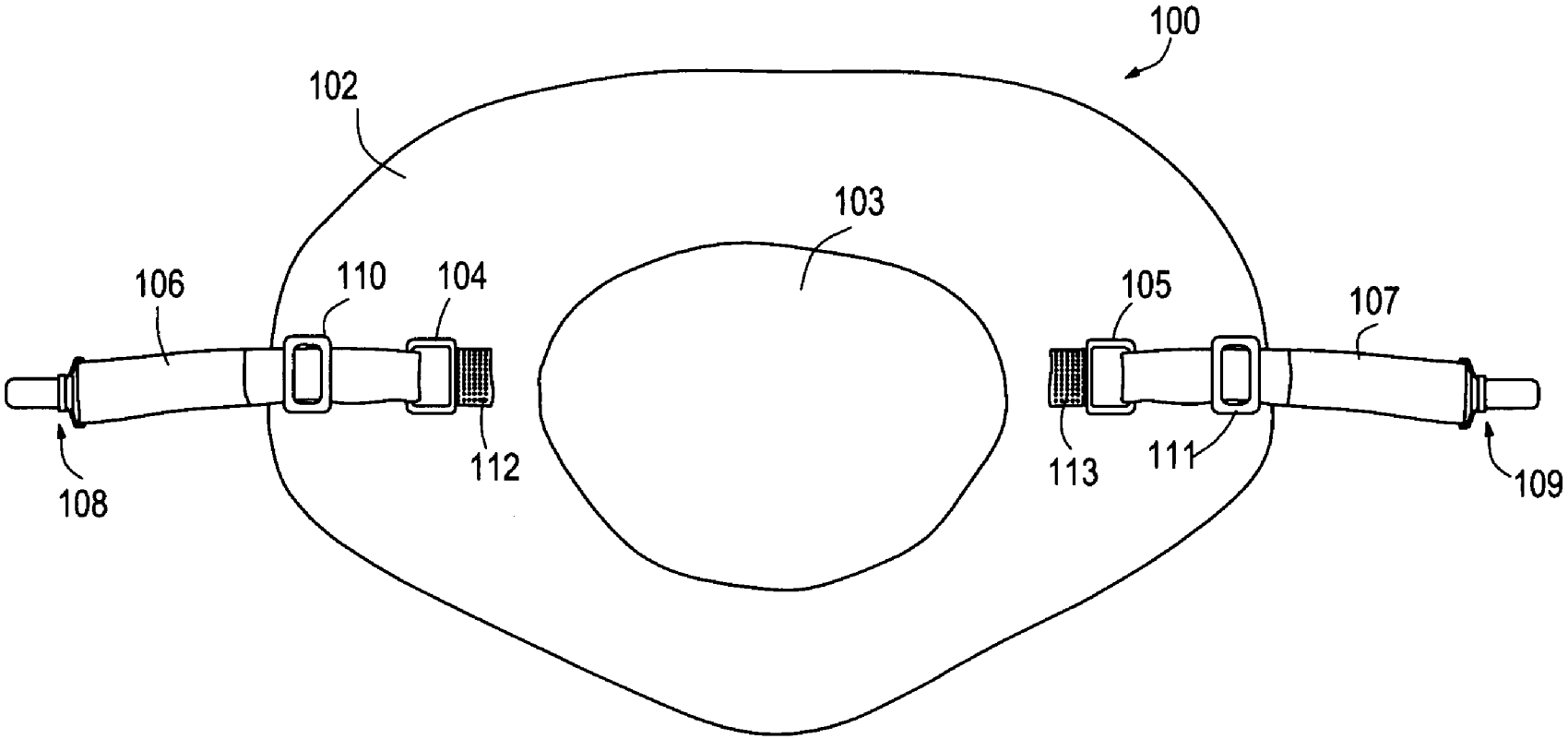
FIG. 1 is a plan view of an embodiment of the present invention.

The sheet of material 102 contains an aperture 103 approximately concentric with the sheet of material 102. In the embodiment of FIG. 1, the aperture 103 is approximately elliptical and is concentric with the outer edge of the sheet of material 102. In this example, the major and minor axes of the aperture 103 are approximately half the length of the axes of the sheet of material 102. However, it will be appreciated that the size and shape of the aperture 103 can be of virtually any size and shape as required by the wearer and may be eccentric relative to the outer edge of sheet of material 102. The size and shape of certain embodiments may be further constrained so as to allow the wearer to pull the sheet of material 102 over the head of the wearer. It will be appreciated that the securing device 100 may be manufactured in many different sizes to accommodate individuals of different sizes.

First and second suspension members 106 and 107 are attached to the sheet of material 102 on its upper side and roughly in line with the major axis on either side of the aperture. In one embodiment, the first and second suspension members 106 and 107 are adjustable, such as nylon straps having buckles 110, 111 allowing the length to be altered to suit the wearer. The length of the first and second suspension members 106 and 107 is a function of the distance from the wearer's neck to the top of the protective pad 114, 115 when worn in the desired position. Alternative suspension members could also include but are not limited to elastic straps, elastomeric straps, hook and loop straps (e.g., Velcro® straps), string, cord, chain, leather, and cloth.

Figure 2:
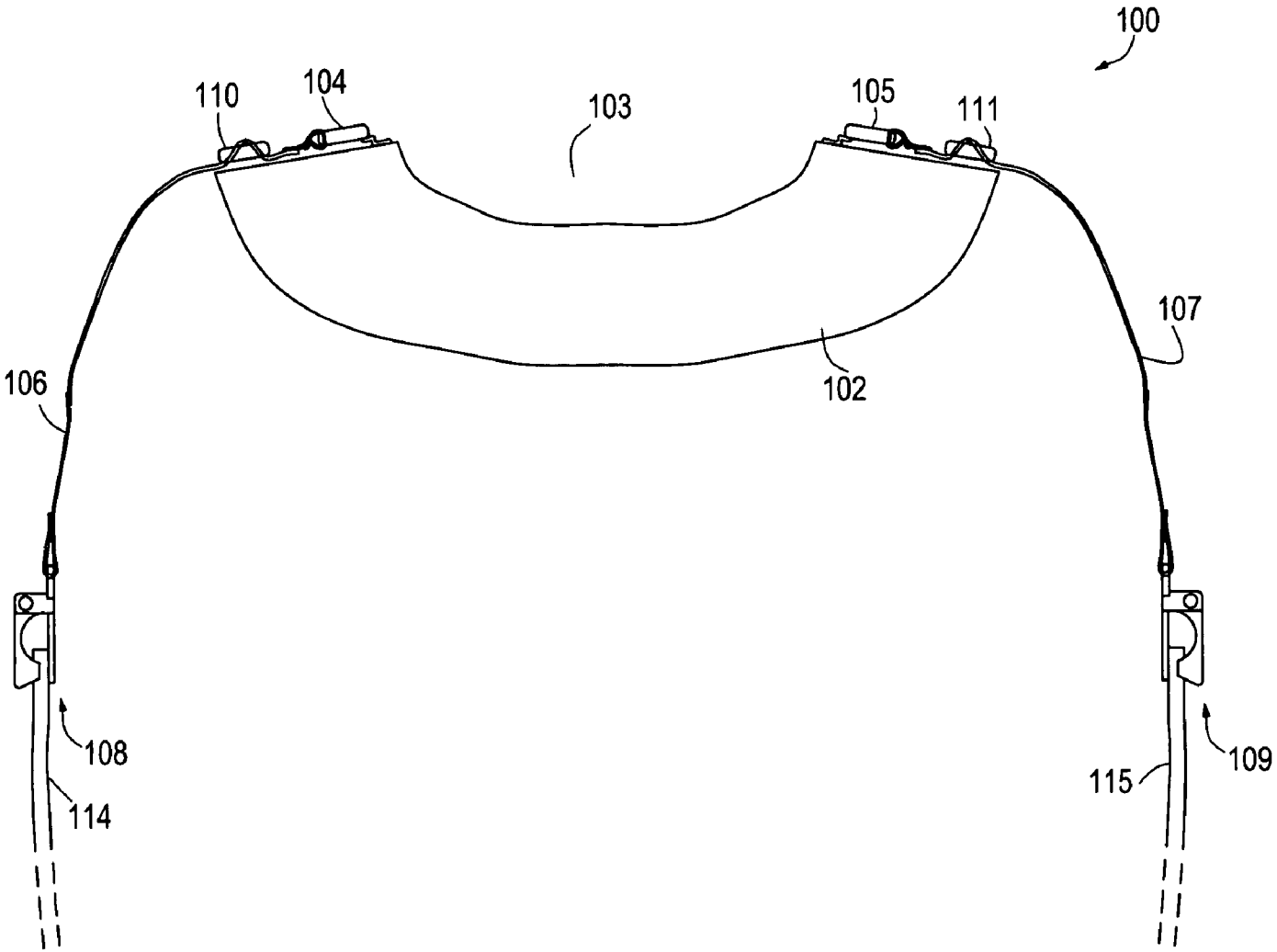
FIG. 2 is a frontal view of an embodiment as worn.

The first and second suspension members 106 and 107 are attached to the sheet of material 102 at their secured ends by D-rings 104 and 105 that are attached to the top side of the sheet of material 102 in the embodiment of FIGS. 1 and 2. The D-rings 104 and 105 of this embodiment are attached in proximity to the inner edge of the aperture 103 to provide stability during use, where being in proximity to the inner edge includes any distance that is closer to the inner edge than the outer edge and may include attachment directly at the inner edge (e.g., within 1-2 inches of the inner edge when sized for an average adult and roughly in line with the major axis). While the D-rings 104, 105 are shown mounted in proximity to the inner edge defining aperture 103, the D-rings 104, 105 could be placed anywhere on the sheet of material 102.

It will be appreciated that other attachment devices such as but not limited to round rings, buckles, clips, sewn thread, or hook and loop tape may be used instead of D-rings 104, 105 to attach the suspension members 106 and 107 to the sheet of material 102. It will also be appreciated that the D-Rings 104 and 105 or other device for connecting the suspension members 106 and 107 to the sheet 102 of material may be attached to the sheet of material 102 in various ways including sewing installation tabs 112, 113 of the D-rings 104, 105 to the sheet 102 as shown for the embodiment of FIGS. 1 and 2 and also including, but not limited to, rivets, glue, hook and loop tape, adhesives, and staples.

In the embodiment of FIGS. 1 and 2, the distal ends of the first and second suspension members 106 and 107 are attached to the tops of the wearer's protective pads 114, 115 by crimping clips 108 and 109 such that the attachment can be accomplished by hand without the aid of tools. One version of a crimping clip would be a suspender clip, well known in the art used to hold up trousers. Alternative attachment mechanisms may also be used such as but not limited to a clasp, clamp, hook, clip or hook and loop straps that would suit the user. Using such an attachment mechanisms allows the wearer to attach his own set of protective pads to the suspension straps 106, 107 and to do so quickly and spontaneously. The crimping clip is attached to the suspension members 106 and 107 by the conventional means of sewing in the embodiment shown. However, alternative means well known in the art such as, but not limited to, rivets, staples and hook and loop tape can also be used.

The sheet of material 102 provides a continuous inner edge defining aperture 103 as well as a continuous outer edge. As shown, the continuous edge is provided by having the material maintain continuity completely around the aperture 103. However, it will be appreciated that rather than having continuity of the material, the sheet 102 may be wholly or partially parted to facilitate placing the sheet 102 over the head of the wearer. In that case, the part may be closed to establish the continuous inner and outer edges such as by lacing, snaps, hook and loop tape, etc.

Figure 3:
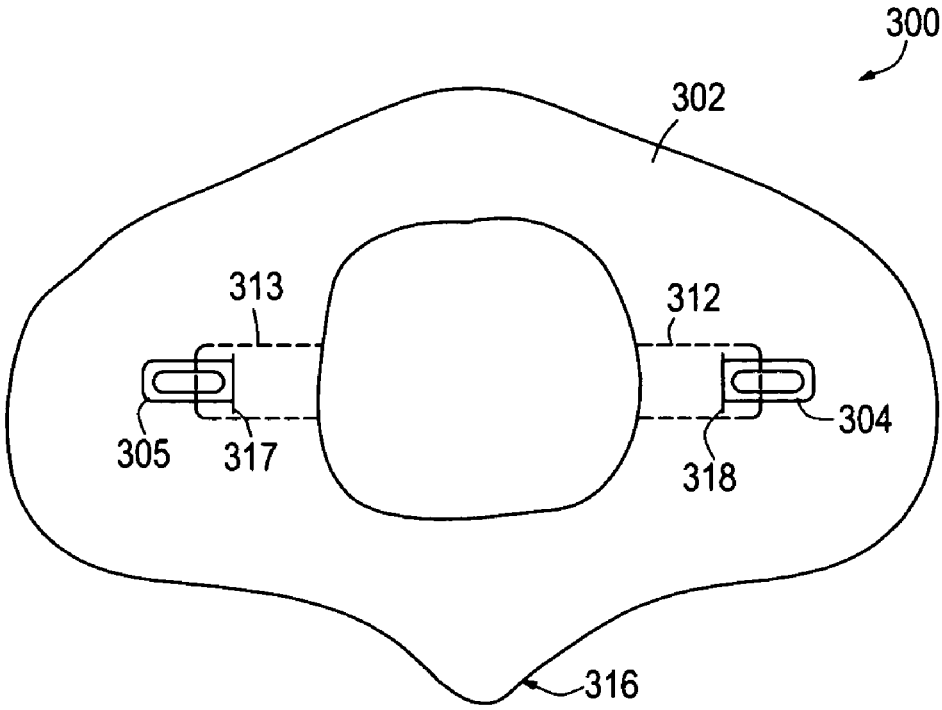
FIG. 3 is a plan view of an embodiment of the present invention with additional features of the shape of the pliable sheet of material and with salient tabs for adding additional material for anchoring the D-rings.
Figure 4:
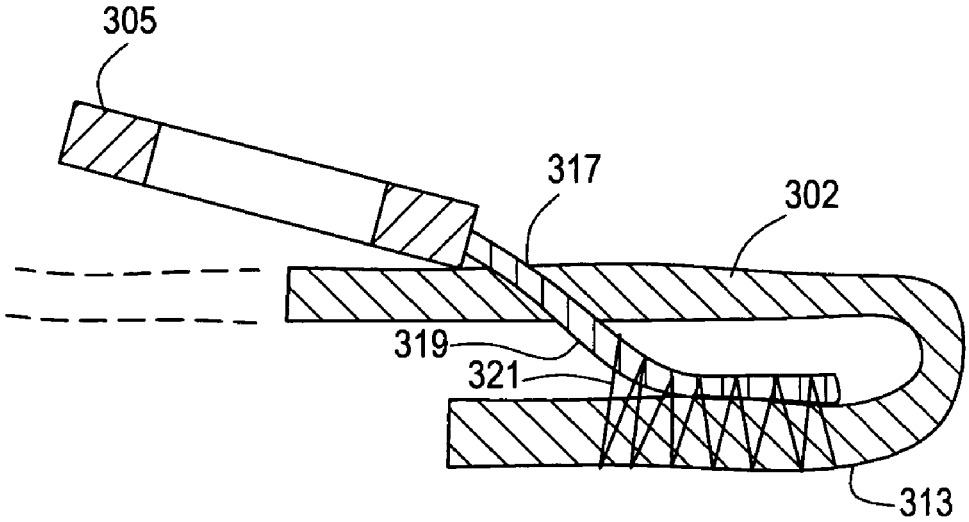
FIG. 4 is a cross-sectional view of the sheet of material of the embodiment of FIG. 3 showing the fold of the tabs and the corresponding attachment of the D-ring.

FIGS. 3 and 4 illustrate still another embodiment of the protective pad securing device 300. The embodiment of FIGS. 3 and 4 is identical to that in FIG. 1 with the following modifications. The two salient tabs 312 and 313 that extend inwards from the edge of the aperture 303 are provided in the sheet of material 302, and the salient tabs 312 and 313 are then folded under the sheet of material 302. The D-rings 304 and 305 are then attached, such as by sewing, to the salient tabs 312, 313 on the underside of the sheet of material 302.

As shown in cross-section in FIG. 4, the D-ring 305 has an installation tab 319 that is placed through a slit 317 (slit 318 for D-ring 304). The installation tab 319 is then attached to the tab 313 that has been folded. As shown, the installation tab 319 is attached to the tab 313 by sewn thread 321, but various other manners of attaching the tab 319 are also applicable. Furthermore, while it is shown with the tab 319 being directly attached only to the folded tab 313, the attachment may also be to the portion of the sheet 102 directly above the tab 313.

The salient tabs 312 and 313 provide a double thick, reinforced area to attach the D-rings 305 and 305 to thereby provide additional stability and structural integrity for the securing device 300. The suspension straps 306 and 307 are connected to the D-rings 305 and 306 in the same manner as in FIG. 1 discussed above.

FIG. 3 also illustrates an additional modification wherein a triangular shaped tab 316 is included for the sheet of material 302 such that it extends down the back of the wearer. As one example, for an average sized adult, the tab 316 may extend several inches and between the wearer's shoulder blades. The triangular tab 316 engages the shoulder blades during movement of the wearer and reduces any rotational movement of the sheet of material 302 about the wearer's neck. It is important to note that salient tabs 312 and 313 and the triangular shaped tab 316 are independent features and can be used in conjunction and separately with any embodiment of the protective pad securing device.

While the invention has been particularly shown and described with reference to various embodiments thereof, it will be understood by those skilled in the art that various other changes in the form and details may be made therein without departing from the spirit and scope of the invention.

What is claimed is:

1. A sports apparatus that secures a position of protective pads worn on each arm of a user, comprising:

a single continuous sheet of pliable material bounded by a continuous outer edge and containing an aperture therein bounded by a continuous inner edge of the single continuous sheet of pliable material, the aperture being sized to allow a head of the user to pass through so that the single continuous sheet rests on shoulders of the user;

the single continuous sheet is shaped to have a major axis parallel with the shoulders and a minor axis such that the major axis is larger than the minor axis a first means for detachably suspending a first protective pad from the single continuous sheet of pliable material, the first means comprising:

a first strap having a first end and a second end, the second end having a means for attaching to the first protective pad, a first ring attached to the single continuous sheet of pliable material at a location adjacent to the continuous inner edge that bounds the aperture with only the first end of the first strap being attached to the first ring such that the first strap has freedom of movement about the attachment of the first end of the first strap to the first ring;

a second means for detachably suspending a second protective pad from the single continuous sheet of pliable material at a position on substantially the opposite side of the aperture from the first means, the second means comprising:

a second strap having a first end and a second end, the second end having a means for attaching to the second protective pad, a second ring attached to the single continuous sheet of pliable material at a location adjacent to the continuous inner edge that bounds the aperture with only the first end of the second strap being attached to the second ring such that the second strap has freedom of movement about the attachment of the first end of the second strap to the second ring.

2. The sports apparatus of claim 1, wherein the first strap and the second strap comprise nylon straps and wherein the sheet comprises neoprene.

3. The sports apparatus of claim 1, wherein the sheet of pliable material includes a triangularly-shaped extension.

4. The sports apparatus of claim 1, wherein the means for attaching of the first and second straps comprises a means for removably attaching to the protective pads.

5. The sports apparatus of claim 1, wherein the sheet includes a first folded tab of the sheet of pliable material on one side of the aperture and a second folded tab of the sheet of pliable material on substantially the opposite side of the aperture, and wherein the first ring is attached to the first folded tab and wherein the second ring is attached to the second folded tab.

6. The sports apparatus of claim 1, wherein the first ring includes an installation tab that passes through a first slit in the sheet and wherein the second ring includes an installation tab that passes through a second slit in the sheet.

7. A sports apparatus that secures a position of protective pads worn on each arm of a user, comprising:

a single continuous sheet of material bounded by a continuous outer edge containing an aperture therein bounded by a continuous inner edge of the single continuous sheet of material, the aperture being sized to allow a head of the user to pass through so that the single continuous sheet rests on shoulders of the user;

said single continuous sheet is shaped to have a major axis parallel with the shoulders and a minor axis such that the major axis is larger than the minor axis a first strap, connected to the sheet of material at a location adjacent to the inner edge of the aperture, having a connected end connected to the sheet of material and a distal end that is free from the sheet of material;

a second strap, connected to the sheet of material at a position substantially on the opposite side of the aperture from the first strap and at a location adjacent to the inner edge of the aperture, having a connected end connected to the sheet of material and a distal end that is free from the sheet of material;

a first attachment means for allowing manual attachment and detachment of the first strap to a protective pad and being connected to the distal end of the first strap; and a second attachment means for allowing manual attachment and detachment of the second strap to a protective pad and being connected to the distal end of the second strap.

8. The sports apparatus of claim 7, wherein the sheet of material is pliable.

9. The sports apparatus of claim 7, wherein the aperture is concentric with respect to the outer edge of the sheet of material and is of such a size as to allow a wearer to place his head through the aperture and rest the sheet of material upon the wearer's shoulders.

10. The sports apparatus of claim 7, wherein the sheet of material and the aperture are elliptic.

11. The sports apparatus of claim 7, wherein the connected ends of the first and second straps are secured to the sheet of pliable material by a ring.

12. The sports apparatus of claim 7, wherein the first and second attachment means are clip assemblies.

13. The sports apparatus of claim 12, wherein the clip assembly is a suspender clip.

14. The sports apparatus of claim 1, wherein sheet of pliable material is parted between the inner edge and the outer edge.

15. A sports apparatus that secures a position of protective pads worn on each arm of a user, comprising:

a single continuous sheet of pliable material bounded by a continuous outer edge containing an aperture therein bounded by a continuous inner edge of the single continuous sheet of pliable material, the aperture being sized to allow a head of the user to pass through so that the single continuous sheet rests on shoulders of the user and the single continuous sheet shaped to have a major axis and a minor axis such that the major axis parallel with the shoulders is larger than the minor axis;

a first suspension member with a distal end and a secured end, the secured end being connected to the single continuous sheet of pliable material, the first suspension member comprising:

a first strap having a first end and a second end, the second end having a means for attaching to a first protective pad, a first ring attached to the single continuous sheet of pliable material at a location substantially along the major axis of the single continuous sheet of pliable material with only the first end of the first strap being attached to the first ring such that the first strap has freedom of movement about the attachment of the first end of the first strap to the first ring;

a second suspension member with a distal end and a secured end, the secured end being connected to the sheet of pliable material at a position on substantially the opposite side of the aperture from the first suspension member, the second suspension member comprising:

a second strap having a first end and a second end, the second end having a means for attaching to a second protective pad, a second ring attached to the single continuous sheet of pliable material at a location substantially along the major axis of the single continuous sheet of pliable material with only the first end of the second strap being attached to the second ring such that the second strap has freedom of movement about the attachment of the first end of the second strap to the second ring;

a first attachment device connected to the second end of the first strap, the first attachment device comprising a first clip that allows manual attachment and detachment of the first strap to the first protective pad and being connected to the second end of the first strap;

and a second attachment device connected to the second end of the second strap, the second attachment device comprising a second clip that allows manual attachment and detachment of the second strap to the second protective pad and being connected to the second end of the second strap.

16. The sports apparatus of claim 15, wherein the aperture is of such a size as to allow a wearer to place his head through the aperture and rest the sheet of pliable material upon the wearer's shoulders.

17. The sports apparatus of claim 16, wherein the attachment means connected to the second end of the first strap and the second end of the second strap are detachable clip assemblies.

18. The sports apparatus of claim 15, wherein the sheet of pliable material and the aperture are elliptic.

19. The sports apparatus of claim 15, wherein the first and second suspension members have an adjustable length.

20. The sports apparatus of claim 15, wherein the sheet of pliable material includes a triangular extension on the outer edge between the locations of the first and second suspension members.

* * * * *